US005464366A

United States Patent [19]

Hutchins

[11] Patent Number: 5,464,366

[45] Date of Patent: Nov. 7, 1995

[54] RECIPROCATING ABRADING TOOL

[75] Inventor: Donald H. Hutchins, Sierra Madre, Calif.

[73] Assignee: Hutchins Manufacturing Company, Pasadena, Calif.

[21] Appl. No.: 239,410

[22] Filed: May 6, 1994

[51] Int. Cl.[6] ..... B24B 23/00

[52] U.S. Cl. ..... 451/356; 451/344

[58] Field of Search ..... 451/344, 351, 451/356, 162, 164

[56] References Cited

U.S. PATENT DOCUMENTS

| | | | |
|---|---|---|---|
| 1,017,388 | 2/1912 | Dickson | 451/351 |
| 2,276,534 | 3/1942 | Burleigh | 451/356 |
| 2,499,962 | 3/1950 | Manll et al. | 451/356 |
| 2,772,663 | 12/1956 | Larson | 451/356 |
| 2,786,950 | 3/1957 | Carmichael et al. | 451/356 |
| 4,145,847 | 3/1979 | Hutchins . | |
| 4,228,620 | 10/1980 | Hutchins . | |
| 5,001,869 | 3/1991 | Hutchins . | |
| 5,038,523 | 8/1991 | Farbor et al. | 451/344 |

*Primary Examiner*—Robert A. Rose
*Assistant Examiner*—Eileen P. Morgan
*Attorney, Agent, or Firm*—William P. Green

[57] ABSTRACT

A portable abrading tool including a cylinder body containing a piston which is reciprocable relative to the body under the control of a valve mechanism, a shoe for carrying sandpaper or another abrading element which is reciprocated in a straight line by the piston but oppositely from the reciprocating movement of the piston, a counterweight which is reciprocated essentially in unison with the piston but oppositely from the shoe, and means yieldingly urging the piston and counterweight in a predetermined axial direction and yieldingly urging the shoe in the opposite direction relative to the body to assure that when the operation of the tool is stopped the moving parts of the tool will automatically return to a position in which the valve mechanism is able to deliver fluid to the piston and cylinder structure in a manner recommencing the reciprocating movement. The yielding means preferably take the form of a spring contained within a recess in the underside of the body vertically between the body and shoe of the device and acting to apply force in opposite directions to the counterweight and the body.

11 Claims, 3 Drawing Sheets

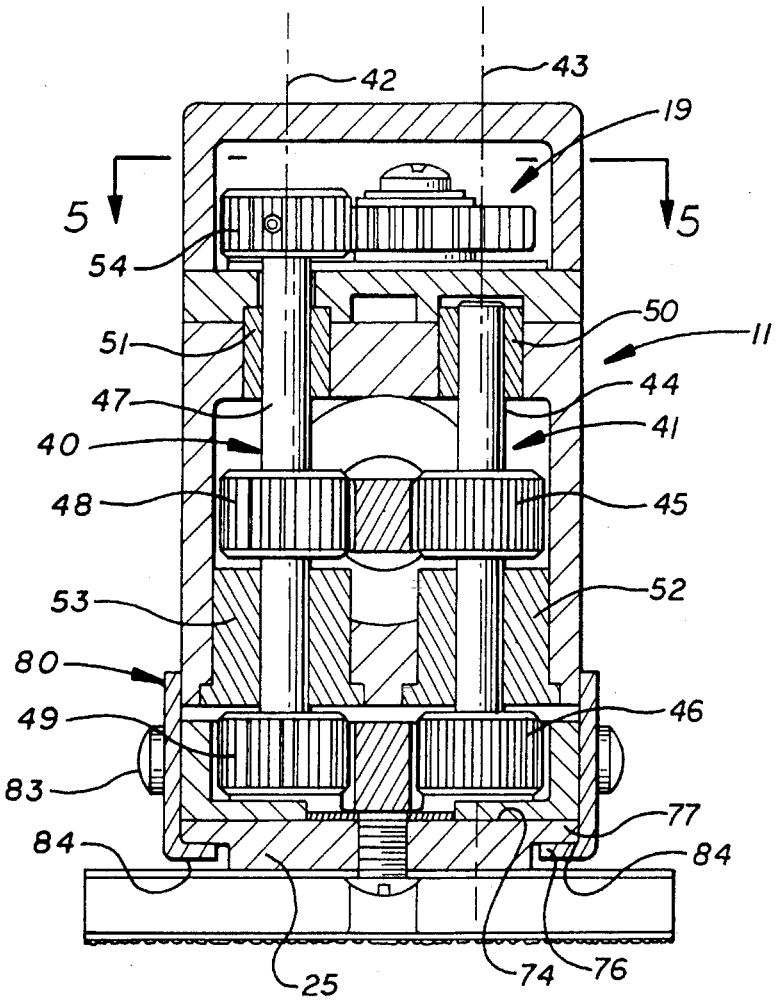
FIG. 3
FIG. 4
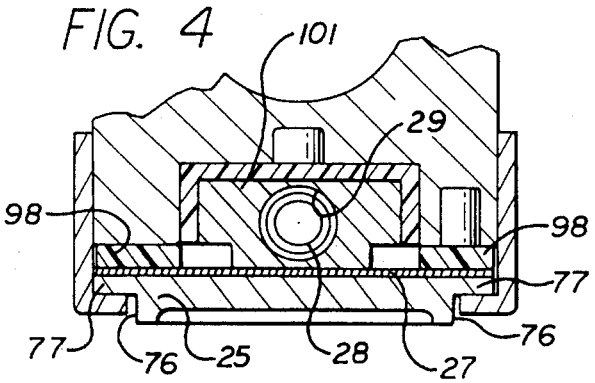
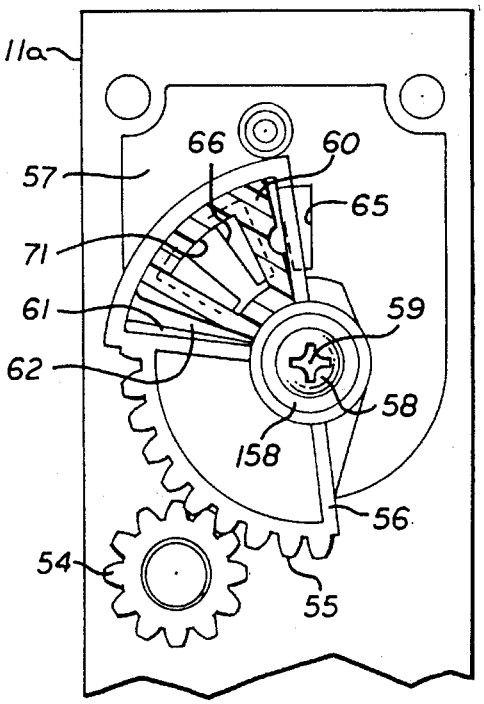
FIG. 5

FIG. 7
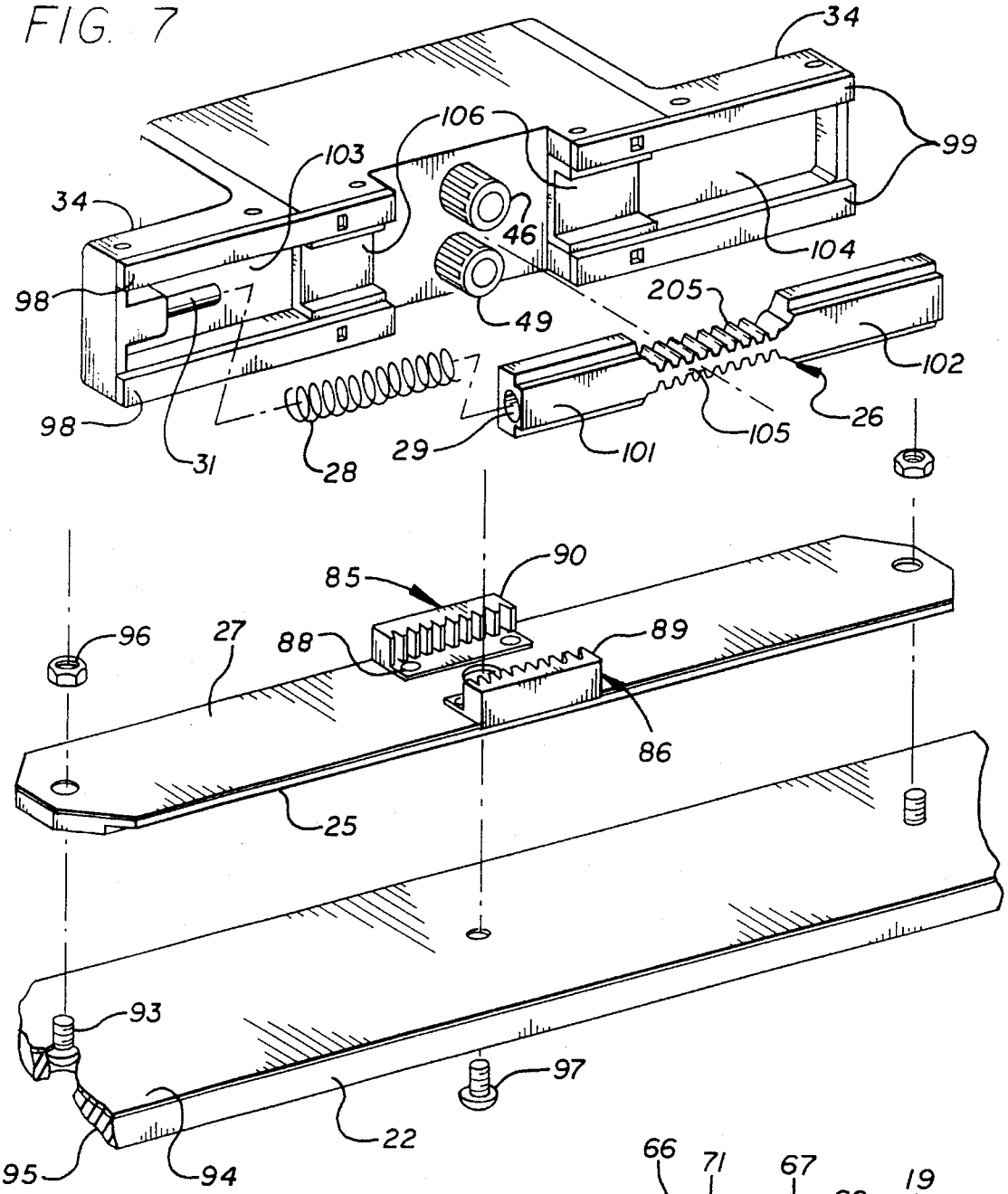
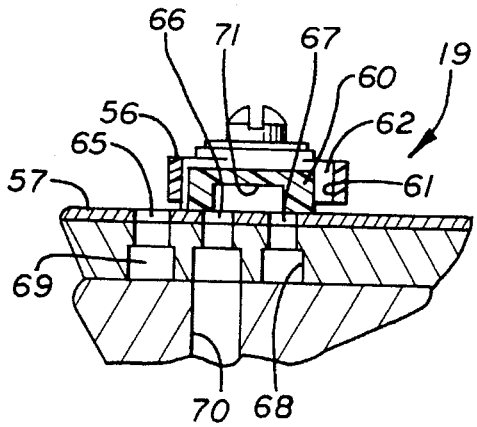
FIG. 6

RECIPROCATING ABRADING TOOL

This invention relates to improved portable power operated sanders or other abrading tools in which an abrading shoe is reciprocated in a straight line relative to a body of the tool.

BACKGROUND OF THE INVENTION

U.S. Pat. No. 4,145,847 issued Mar. 27, 1979 to Alma A. Hutchins on "Straight Line Abrading Tool With Balancing Counterweight" discloses a hand held abrading tool including a piston structure mounted within a cylinder body for reciprocation by air or other pressure fluid delivered to the cylinder chamber by a valve mechanism operating in timed relation to the piston structure. The piston structure drives a reciprocating shoe which carries a sheet of sandpaper or other abrading material, and also drives a counterweight preferably located at the underside of the body and above the shoe. The shoe reciprocates parallel to but oppositely from the piston structure, and the counterweight reciprocates essentially in unison with the piston structure. U.S. Pat. No. 5,001,869 issued Mar. 26, 1991 to Donald H. Hutchins on "Reciprocating Abrading or Polishing Tool With Balancing Counterweights" shows a similar straight line tool having additional counterweights at a level above the shoe and preferably at opposite sides of the piston structure.

In the tools of both of these patents, it is possible, when the delivery of fluid to the tool is shut off, for the moving parts and valve mechanism to stop in a position from which the valve mechanism can not restart the tool when the pressure fluid is again turned on. In using the tools of the prior patents, it is then necessary to manually move the shoe relative to the body to a different position in which the valve mechanism can deliver fluid to the piston structure in a manner recommencing the reciprocating motion.

SUMMARY OF THE INVENTION

The general purpose of the present invention is to provide improved straight line abrading tools which are of the above discussed general type, but in which the mechanism is so designed that whenever it is turned off the moving parts will automatically return to a predetermined position from which the valve mechanism can immediately restart the reciprocating motion when the tool is again turned on. To attain this result, I provide means yieldingly urging the piston structure and counterweight in a predetermined axial direction relative to the body of the tool, and yieldingly urging the shoe in the opposite direction relative to the body, so that when the tool is stopped the parts are urged by the yielding means to the desired self starting positions. The yielding force is preferably applied by a spring acting against the counterweight to urge it in a predetermined direction relative to the body. The spring may be located within a bottom recess in the body and at an end of the counterweight to act in opposite directions against the counterweight and an end wall of the recess.

BRIEF DESCRIPTION OF THE DRAWINGS

The above and other features and objects of the invention will be better understood from the following detailed description of the typical embodiment illustrated in the accompanying drawings, in which:

FIG. 3 is enlarged vertical section taken on line 3—3 of FIG. 1;

FIG. 4 is a vertical section taken on line 4—4 of FIG. 2;

FIG. 5 is an enlarged detail representation of the automatic valving mechanism, taken on line 5—5 of FIG. 3;

FIG. 6 is a fragmentary vertical section taken on line 6—6 of FIG. 5; and FIG. 7 is an exploded perspective view showing the underside of the tool body and the parts carried beneath the tool body.

DETAILED DESCRIPTION OF THE PREFERRED EMBODIMENT

Figure 1:
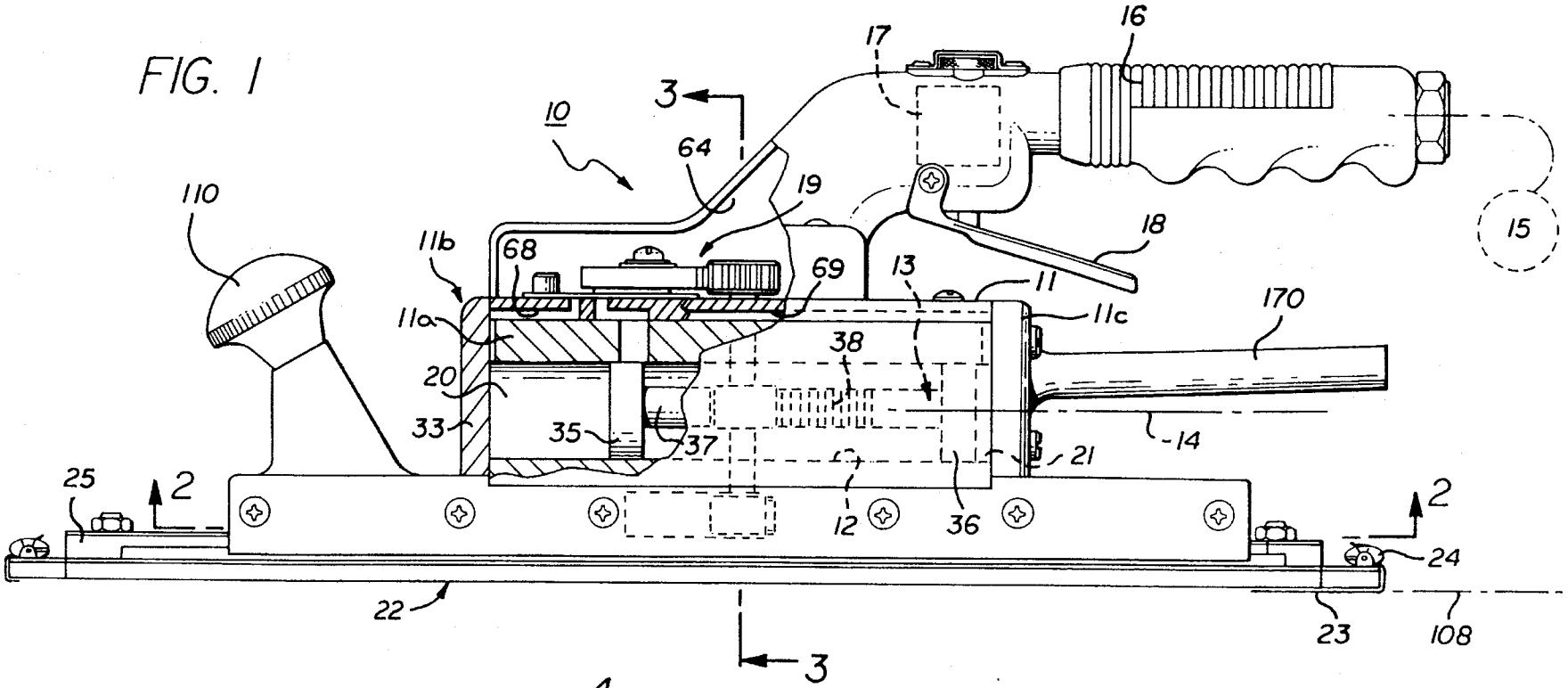
FIG. 1 is a side elevational view, partially broken away, of a power sander constructed in accordance with the invention.

With reference first to FIG. 1, the sander 10 there shown includes a main body 11 containing a cylindrical bore 12 within which a piston 13 is reciprocated along an axis 14. Compressed air or other pressure fluid is delivered from a source 15 of such fluid to the opposite ends of cylinder bore 12 through a tubular handle 16 which is rigidly secured to or forms a portion of body 11. A valve 17 manually actuated by a trigger element 18 controls the delivery of compressed air to the reciprocating piston through an automatic valve assembly 19 which alternately admits the compressed air to cylinder chambers 20 and 21 at opposite ends of the piston at times causing powered reciprocation of the piston. An elongated pad 22 extending along the underside of body 11 is reciprocated in a straight line motion parallel to axis 14, and carries a sheet of sandpaper 23 at its underside for abrading a work surface upon such reciprocating movement. The sandpaper sheet is secured detachably to pad 22, typically by spring clips 24 at opposite ends of the pad or by an appropriate adhesive securing the sandpaper to the underside of the pad.

Pad 22 is attached to and movable with a shoe plate 25 of the tool, which is attached to the underside of body 11 for straight line reciprocating movement relative to the body. Vertically between shoe plate 25 and body 11 is a counterweight 26 which reciprocates with piston 13 but oppositely from the shoe plate and pad 22 to balance the mechanism in a manner preventing or minimizing vibration of the body itself during operation of the tool. A wear plate 27 is carried at the upper side of and movable with shoe plate 25.

Figure 2:
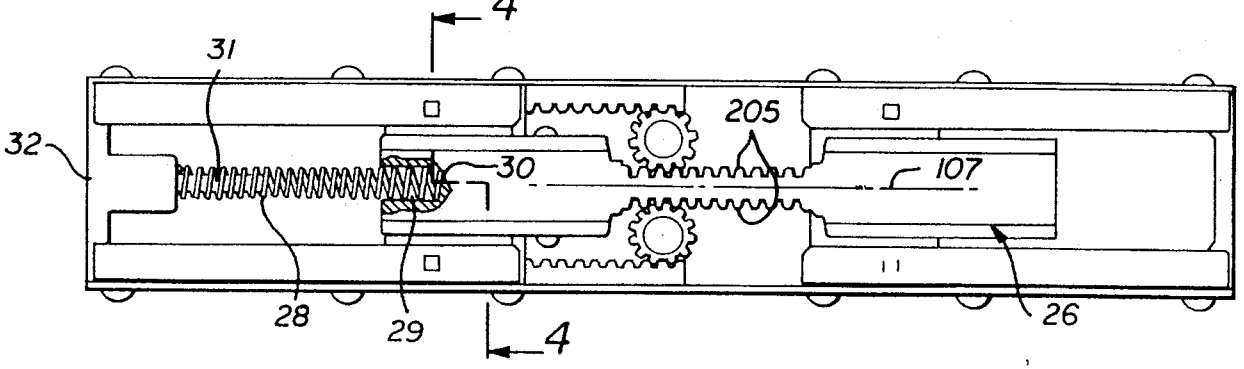
FIG. 2 is bottom view of the tool body, taken on line 2—2 of FIG. 1.

The present invention is particularly concerned with the provision of a coil spring 28 at the underside of the tool body 11 (see FIG. 2), located beyond the forward end of counterweight 26 and bearing in opposite directions against the counterweight and body 11. One end of spring 28 may be received within a cylindrical recess 29 in the counterweight, to bear axially against the end wall 30 of that recess, while the other end of spring 28 may be received about and located by a cylindrical projection 31 carried by an end wall 32 of body 11. The forward end of spring 28 thus applies yielding force in a forward direction against end wall 32.

Body 11 may be formed sectionally of several parts secured rigidly together, including a main central section **11*a* and two opposite end members 11*b* and 11*c* having vertical portions 33 secured to the opposite ends of section 11*a* to form end walls closing bore 12. Members 11*b* and 11*c* also have lower portions 34 (see FIG. 7) which project horizontally in opposite directions at the upper side of shoe plate 25**.

Piston 13 is preferably double ended, having two piston heads 35 and 36 at its opposite ends interconnected by a reduced diameter portion 37 of the piston having two sets of rack teeth 38 and 39 at its opposite sides. Two gear units 40 and 41 engage and are driven by the rack teeth 38 and 39 on the piston structure, and are mounted to turn relative to body 11 about two parallel vertical axes 42 and 43 lying in a common vertical plane disposed transversely of axis 14 of the piston. Gear unit 41 has a vertical shaft 44 rigidly carrying two vertically spaced gears 45 and 46, the first of which meshes with and is oscillated rotatively by rack teeth 39 of piston 13. The second gear unit 40 includes a vertical shaft 47 rigidly carrying two vertically spaced gears 48 and 49, with gear 48 engaging rack teeth 38 at the second side of the reduced diameter portion of piston 13. Shafts 44 and 47 may be journalled for their rotary movement relative to the body by sleeve bushings 50 and 51 engaging upper portions of the shafts and bushings. 52 and 53 engaging lower portions of the shafts and constructed to function as thrust bearings supporting the shafts in the FIG. 3 positions.

The automatic valve mechanism 19 for delivering air to the cylinder bore of piston 13 may be any appropriate valving unit capable of performing the desired function, but preferably is a rotatively oscillating sector valve assembly driven by one of the vertical shafts 44 or 47, typically the latter. This valving mechanism has been shown and described in some detail in U.S. Pat. Nos. 3,932,963, 4,145,847, 4,228,620 and 5,001,869, whose disclosures are incorporated herein by reference. The valve assembly may include an upper gear 54 rigidly secured to and turning with shaft 47 and meshing with an arcuate series of teeth 55 on a sector element 56 (FIG. 5) received adjacent an upper horizontal plate 57 secured to the top surface of main body section 11a. Sector part 56 of the valve mechanism is mounted by a screw 58 and surrounding bushing 158 secured to body 11 for rotary oscillating movement about a vertical axis 59, to actuate a valve element 60 which is shaped essentially as a sector of a circle and is received within a similarly shaped recess 61 formed in sector element 56. The sector shaped recess 61 has a greater arcuate dimension than does sector shaped valve element 60, to leave a gap 62 between part 60 and the side or sides of the recess or opening 61, so that there is some lost motion between the oscillation of part 56 and part 60.

Referring now to FIG. 1, the air from source 15 flows past manually actuated valve 17 into an inlet chamber 64 formed within hollow handle member 16 and above section 11*a* of body 11 of the tool. Valve assembly 19 acts to control the delivery of compressed air from inlet chamber 64 to the opposite ends of the piston 13. Plate 57 at the underside of parts 56 and 60 contains three radially elongated sector shaped apertures 65, 66 and 67 (FIGS. 5 and 6). Of these, the two end apertures 65 and 67 communicate with two passages 69 and 68 respectively (FIG. 1) in body part 11*a* leading to chambers 21 and 20 respectively at opposite ends of the piston. The third aperture 66, which is between apertures 65 and 67, communicates with an exhaust passage 70 leading to a tube 170 through which air may be discharged from the valve assembly to atmosphere.

Valving element 60 contains a sector shaped recess 71 at its underside of a width to place exhaust passage 70 alternately in communication with the two passages 68 and 69. In the particular position illustrated in FIG. 6, the passage 68 is exhausting to atmosphere while the passage 69 is receiving inlet air from chamber 64. When sector element 56 oscillates in a clockwise direction from the position of FIG. 5, element 56 first turns through a small angle without corresponding movement of valve element 61, following which valve element 60 commences to turn with sector element 56, with the amount of lost motion between the parts being determined by the width of gap 62. Element 60 ultimately moves to a position in which passages 69 and 70 are placed in communication with one another through recess 71 at the underside of element 60, and with passage 68 then being in communication with the inlet air chamber 64. From the above discussion, it is seen that the oscillating valve element 60 first admits air to chamber 21 at the right side of piston 13 in FIG. 1 while exhausting air from chamber 20 at the left end of the piston, and then at the end of a leftward stroke of the piston reverses the connections to admit air to chamber 20 and exhaust it from chamber 21 and cause rightward movement of the piston, thus resulting in automatic reciprocation of the piston and corresponding rotary oscillation of the gear units 40 and 41.

Shoe plate 25 is a rigid preferably metal part having the cross section illustrated in FIG. 3, to provide an upper horizontal planar surface 74 at the top of the shoe plate engaged by wear plate 27. Along its opposite sides, the shoe contains two recesses 76 at its underside forming a pair of laterally projecting reduced thickness horizontal flanges 77 extending parallel to axis 14.

A pair of track or rail members 80 are connected to opposite sides of the lower portion of body 11 by screws 83, and have horizontally inturned flanges 84 slidably engaging the undersurfaces of flanges 77 to guide the shoe for straight line reciprocating movement parallel to axis 14. Shoe plate 25 rigidly carries two rack members 85 and 86 at its upper side, with the rack members typically having horizontal portions secured by rivots 88 to plate 25 and having upwardly projecting portions 89 with inwardly facing rack teeth 90 meshing with outer sides of the previously mentioned lower gears 46 and 49 on shafts 44 and 47. This rack and gear engagement results in straight line reciprocation of shoe 25 parallel to axis 14 and in response to rotary oscillation of shafts 44 and 47 by piston 13.

The wear plate 27 at the upper side of shoe plate. 25 is a thin metal plate on which counterweight 26 is slidably movable, and has been described in greater detail in U.S. Pat. No. 4,228,620. Plate 27 may be secured to shoe 25 by a pair of screws 93 also serving to retain pad 22 to the shoe. Pad 22 preferably includes an upper essentially stiff metal horizontal plate 94, carrying at its underside a pad 95 formed of rubber or other elastomeric material and suitably adhered to plate 94. Screws 93 extend vertically through plates 94, 25 and 27, and have nuts 96 at their upper ends attaching these parts tightly together. A similar but shorter additional screw 97 attaches plate 94 to plate 25 at a central location, with that screw being threadedly connected to plate 25 and having a head at the underside of plate 94.

As seen best in FIGS. 4 and 7, body 11 of the tool carries at its underside two forward bearing elements 98 extending along opposite sides of the body, and two similar rear bearing elements 99. These bearing elements 98 and 99 may be formed of thin strips of an appropriate low friction, low wear resinous plastic material. Each of the four bearing elements has a horizontal undersurface slidably engaging the horizontal upper surface of wear plate 27 near its opposite side edges, to apply downward force to plate 25 and pad 22 from the body. Bearing elements 99 and 98 are secured to body 11 of the tool in fixed position relative thereto in any appropriate manner.

Counterweight 26 is slidably received within the lower portion of body 11 of the tool, and has two relatively wide front and rear portions 101 and 102 slidably received and guided within front and rear recesses 103 and 104 formed in body 11. A central reduced width portion 105 of the counterweight interconnects its opposite end portions 101 and 102 and is received between and has rack teeth 205 engaging the two lower gears 46 and 49 of gear units 41 and 40 to cause straight line front to rear reciprocation of the counterweight corresponding to and in the same direction as the reciprocation of piston 13. The cross section of each of the wider portions 101 and 102 of the counterweight may be as shown in FIG. 4. At opposite sides of each of the portions 101 and 102 of the counterweight, body 11 of the tool may carry two U-shaped bearing elements 106, which are appropriately secured to the walls of the recesses 103 and 104, and which slidably engage enlargements 101 and 102 of the counterweight to effectively guide them for only the desired reciprocating movement along an axis 107 parallel to and beneath axis 14 of the piston. The counterweight is of course retained against vertical movement relative to the body by engagement at the underside of the counterweight with wear plate 27 and by sliding engagement at the upper side of the counterweight with bushings 106.

Coil spring 28 may be centered about the axis 107 of reciprocating movement of counterweight 26. Similarly, the cylindrical recess 29 in the forward end of the counterweight and the projection 31 about which the forward end of the spring is received may be centered about axis 107. Spring 28 normally urges the counterweight to its rearmost position illustrated in FIG. 2. In that position, piston 13 is similarly in its rearmost position of FIG. 1, and the reciprocating shoe plate 25 and its carried pad 22 and sandpaper 23 are in their forwardmost position also illustrated in FIG. 1. The axis 108 of reciprocating movement of plate 25 and pad 22 is parallel to axis 14 of the piston and axis 107 of the counterweight.

In using the tool illustrated in the drawings, an operator grasps handle 16 and a forward handle 110, and actuates trigger 18 to open valve 17 for admitting air into inlet chamber 64 at the top of the body. Valve mechanism 19 alternately admits air to chambers 20 and 21 at the opposite ends of piston 13, in the manner previously discussed, to effect reciprocation of that piston. Gear units 40 and 41 cause the counterweight 27 to reciprocate in unison with the piston, and cause the shoe plate 25, wear plate 27, pad 22, and sandpaper to reciprocate oppositely from the piston and counterweight.

When the operator releases trigger 18 to shut off the flow of air through valve 17, the piston and other parts cease their reciprocating motion. Spring 28 then becomes effective to automatically return the parts to the positions illustrated in FIGS. 1 and 2, with the counterweight and piston at the right end of their range of travel, and with the shoe plate 25 and pad 22 at the left end of their range of travel. The automatic valve actuating sector element 56 is similarly at one end of its range of rotary oscillatory movement, and valve element 60 is in its extreme position represented in FIG. 6. In that condition, the valve mechanism is prepared to immediately recommence reciprocating movement of the piston and other parts whenever manually actuated control valve 17 is again opened. As soon as the valve 17 is opened, air is immediately delivered past automatic valve 60 to the right end of piston 13, and is exhausted from the left end of the piston. Spring 28 thus prevents the valve mechanism from stalling in a central position in which air could not discharge from either end of the piston (because neither of the passages 68 and 69 could communicate with exhaust passage 70).

While a certain specific embodiment of the present invention has been disclosed as typical, the invention is not limited to this particular form, but rather is applicable broadly to all such variations as fall within the scope of the appended claims.

I claim:

1. A portable abrading tool comprising:

a cylinder body adapted to be held and manipulated by a user;

a piston structure mounted in said body for reciprocation relative thereto along a predetermined axis between two end positions;

valve means automatically operable in timed relation to the piston structure for admitting pressurized fluid to said cylinder body in a relation causing reciprocation of the piston structure;

a control valve manually actuable between an open position passing pressurized fluid from a source thereof to said automatically operable valve means to commence reciprocation of the piston structure, and a closed position preventing delivery of pressurized fluid to said valve means and thereby stopping reciprocation of the piston structure;

a shoe mounted for reciprocation relative to said body and parallel to said axis between two end positions of the shoe to abrade a work surface;

a counterweight mounted for reciprocation parallel to said axis between two end positions of the counterweight;

means driven by said piston structure for reciprocating said shoe relative to said body but oppositely from the piston structure, and reciprocating the counterweight essentially in unison with the piston structure and oppositely from said shoe; and yielding means acting, when said control valve is closed, stopping reciprocation of the piston structure, shoe and counterweight, to urge and move the piston structure and counterweight in a predetermined axial direction, and then retain said piston structure and counterweight each in a predetermined one of its end positions, and acting to yieldingly urge and move said shoe in the opposite direction and then retain it in a predetermined one of its end positions.

2. A portable abrading tool as recited in claim 1, in which said yielding means comprise a coil spring.

3. A portable abrading tool as recited in claim 1, in which said yielding means apply force in said predetermined axial direction to said counterweight.

4. A portable abrading tool as recited in claim 1, in which said yielding means include a spring interposed between portions of said cylinder body and said counterweight to yieldingly urge the counterweight in said predetermined axial direction relative to said body.

5. A portable abrading tool as recited in claim 1, in which said shoe is carried at the underside of said body in a predetermined position of the tool, and said counterweight is slidably received vertically between the body and shoe.

6. A portable abrading tool as recited in claim 1, in which said shoe is carried at the underside of said body in a predetermined position of the tool, and said counterweight is slidably received vertically between the body and shoe, said yielding means including a spring located vertically between said body and shoe and beyond an end of said counterweight and acting against said end of the counterweight to yieldingly urge the counterweight in said predetermined axial direction.

7. A portable abrading tool as recited in claim 1, in which said means driven by said piston structure include a gear unit oscillated about a second axis by the piston structure and having teeth near its lower end engaging rack teeth on the counterweight to reciprocate the counterweight in unison with the piston structure, said yielding means being positioned to apply yielding force in said predetermined axial direction to said counterweight.

8. A portable abrading tool as recited in claim 1, in which said counterweight has two enlarged end portions and a reduced width portion therebetween, said means driven by the piston structure including two gear units oscillated in opposite directions by the piston structure and having teeth near their lower ends engaging rack teeth at opposite sides of said reduced width portion of the counterweight to reciprocate the counterweight essentially in unison with the piston structure, said yielding means including a spring located beyond an end of one of said enlarged portions of the counterweight and applying yielding force to said portion in said predetermined axial direction.

9. A portable abrading tool comprising:

a cylinder body adapted to be held and manipulated by a user;

a piston structure mounted in said body for reciprocation relative thereto along a predetermined axis between two end positions;

valve means automatically operable in timed relation to the piston structure for admitting pressurized fluid to said cylinder body in a relation causing reciprocation of the piston structure;

a control valve manually actuable between an open position passing pressurized fluid from a source thereof to said automatically operable valve means to commence reciprocation of the piston structure, and a closed position preventing delivery of pressurized fluid to said valve means and thereby stopping reciprocation of the piston structure;

a shoe located at the underside of said body in a predetermined position thereof and mounted for reciprocation relative to said body and parallel to said axis between two end positions of the shoe to abrade a work surface;

a counterweight having two enlarged end portions and a reduced width portion therebetween and which is mounted within a recess in the underside of said body for reciprocation parallel to said axis between two end positions of the counterweight;

two gear units oscillated in opposite directions about two vertical axes by said piston structure and having teeth at their lower ends engaging rack teeth on said shoe and rack teeth on said reduced width portion of the counterweight to reciprocate said shoe relative to said body but oppositely from the piston structure, and reciprocate the counterweight essentially in unison with the piston structure and oppositely from said shoe; and a coil spring interposed operatively between an end of said counterweight and an end wall of said recess in the cylinder body and acting, when said control valve is closed, stopping reciprocation of the piston structure, shoe and counterweight, to urge and move the piston structure and counterweight in a predetermined axial direction, and then retain said piston structure and counterweight each in a predetermined one of its end positions, and acting to yieldingly urge and move said shoe in the opposite direction and then retain it in a predetermined one of its end positions.

10. A portable abrading tool comprising:

a cylinder body adapted to be held and manipulated by a user;

a piston structure mounted in said body for reciprocation relative thereto along a predetermined axis between two end positions;

valve means automatically operable in timed relation to the piston structure for admitting pressurized fluid to said cylinder body in a relation causing reciprocation of the piston structure;

a control valve manually actuable between an open position passing pressurized fluid from a source thereof to said automatically operable valve means to commence reciprocation of the piston structure, and a closed position preventing delivery of pressurized fluid to said valve means and thereby stopping reciprocation of the piston structure;

a shoe mounted for reciprocation relative to said body and parallel to said axis between two end positions of the shoe to abrade a work surface;

means driven by said piston structure for reciprocating said shoe relative to said body but oppositely from the piston structure; and yielding means acting, when said control valve is closed, stopping reciprocation of the piston structure and shoe, to urge and move the piston structure in a predetermined axial direction, and then retain it in a predetermined one of its end positions, and acting to yieldingly urge and move said shoe in the opposite direction and then retain it in a predetermined one of its end positions.

11. The combination comprising:

a cylinder body;

a piston structure mounted in said body for reciprocation relative thereto along a predetermined axis;

valve means automatically operable in timed relation to the piston structure for admitting pressurized fluid to said cylinder body in a relation causing reciprocation of the piston structure;

a control valve manually actuable between an open position passing pressurized fluid to Raid automatically operable valve means to commence reciprocation of the piston structure, and a closed position preventing delivery of pressurized fluid to said valve means and thereby stopping reciprocation of the piston structure; and yielding means acting, when said control valve is in closed position, stopping reciprocation of the piston structure, to urge and move the piston structure in a predetermined axial direction and then retain it in a predetermined one of said end positions thereof.

* * * * *